United States Patent [19]

Ohya et al.

[11] Patent Number: 4,734,666

[45] Date of Patent: Mar. 29, 1988

[54] MICROWAVE APPARATUS HAVING COAXIAL WAVEGUIDE PARTITIONED BY VACUUM-TIGHT DIELECTRIC PLATE

[75] Inventors: Keiji Ohya, Yokosuka; Yoshio Kawakami, Yokohama, both of Japan

[73] Assignee: Kabushiki Kaisha Toshiba, Kawasaki, Japan

[21] Appl. No.: 39,281

[22] Filed: Apr. 17, 1987

[30] Foreign Application Priority Data

Apr. 18, 1986 [JP] Japan ..... 61-89406

[51] Int. Cl.[4] ..... H01P 7/06

[52] U.S. Cl. ..... 333/230; 333/252; 315/39.53

[58] Field of Search ..... 333/252, 248, 254, 33; 315/39.53, 39

[56] References Cited

U.S. PATENT DOCUMENTS 3,768,327 10/1956 Millman ..... 315/39.53

4,683,401 7/1987 Okazaki ..... 333/252 X

FOREIGN PATENT DOCUMENTS 56-42097 10/1981 Japan .

61-82639 4/1986 Japan .

*Primary Examiner*—Eugene R. LaRoche

*Assistant Examiner*—Seung Ham

*Attorney, Agent, or Firm*—Cushman, Darby & Cushman

[57] ABSTRACT

In a microwave apparatus with an air-tight window plate, first and second coaxial waveguide assemblies are coupled to each other so that a coaxial waveguide is formed. The first and second inner conductor sections of the first and second assemblies have first and second metal blocks. The first metal block is fitted in the second metal block by a shinkage fit and the first outer conductor section of the first assembly is air-tightly welded to the second outer conductor section of the second assembly. An RF matching annular groove is defined between the first and second metal blocks.

8 Claims, 7 Drawing Figures

MICROWAVE APPARATUS HAVING COAXIAL WAVEGUIDE PARTITIONED BY VACUUM-TIGHT DIELECTRIC PLATE

BACKGROUND OF THE INVENTION

The present invention relates to a coaxial waveguide assembly with an air-tight window plate made of a dielectric material and, more particularly, to an output section of a microwave tube such as a klystron.

An output section of a conventional microwave tube such as a klystron is exemplified by a structure wherein a coaxial waveguide is connected to an output reasonant cavity and a rectangular waveguide is connected to the distal end of the coaxial waveguide. An air-tight window plate made of a dielectric ceramic material is air-tightly mounted on the distal end of the coaxial waveguide assembly. A typical arrangement of a straight beam multicavity klystron having the above coaxial waveguide is shown in FIG. 1. As shown in FIG. 1, the klystron body comprises intermediate resonant cavity 11, drift tube 12, output cavity 13, and collector section 14, all of which are connected in tandem with each other along the axial direction of the klystron. Coaxial waveguide assembly 15 serving as an output section is air-tightly connected to part of the cavity wall of output cavity 13. Assembly 15 comprises inner and outer conductors 16 and 17. Cooling water circulates in inner conductor 16 in a direction indicated by arrow Q. Similarly, cooling water circulates in outer conductor 17. Conductors 16 and 17 comprise large-diameter sections 18 and 19 formed such that the diameters of conductors 16 and 17 are increased midway thereof, respectively. Dielectric air-tight window plate 20 is air-tightly joined between the large-diameter sections 18 and 19. Large-diameter sections 18 and 19 have joint sections **18*a* and 19*a* at which conductors 17 and 18 are separated into halves along their axial direction. Joint sections 18*a* and 19*a* are located near the output resonance cavity with respect to air-tight window plate 20. Joint sections 18*a* and 19*a* are obtained by electrically connecting the halves into integral air-tight assembly by arc welding or the like. The distal end of coaxial waveguide 15 is connected to rectangular waveguide 21. More specifically, the distal end flange of large-diameter section 19 of the outer conductor is connected to an opening of wide surface 22 of rectangular waveguide 21. Distal end 18*b* of large-diameter section 18 is electrically and mechanically connected to wide surface 24 of rectangular waveguide 21 through cup-like enlarged section 23. It should be noted that opening flange 25** of the output waveguide is connected to an external RF load circuit.

In particular, conventional coaxial waveguide assemblies for high-power applications employ structures wherein air-tight joint sections are externally cooled in order to protect the internal and external joint sections of the air-tight window plates made of a dielectric material. Furthermore, in order to prevent the dielectric air-tight window plate from being damaged by multipactor discharge, a coating layer for suppressing the multipactor discharge is formed on the inner surface of the window plate. For this reason, in assembly of the coaxial waveguide assembly, the inner and outer conductor parts joined to the air-tight window plate are prepared separately from other parts such as inner and outer conductor sections 16, 17 connected to the resonance cavity. In the final stage of assembly, they are joined together to constitute an integral klystron assembly. In a conventional klystron, the inner and outer conductors are joined together by welding.

However, if welded parts of the inner and outer conductors are present as parts through which an RF current flows, these welded parts are undesirably heated. In order to prevent heat generation, a metal material (e.g., copper) having a high conductivity is used as a welding material for the welded parts. However, reliability of the welded parts is often degraded undesirably due to the properties of the welding material. Moreover, if the inner conductor must be welded within the outer conductor assembly in which the air-tight window plate made is not air-tightly welded thereto, it is very difficult to perform welding due to the presence of the outer conductor. In such a conventional structure, high reliability of the integral parts of the inner and outer conductors in the coaxial waveguide cannot be satisfactorily obtained.

SUMMARY OF THE INVENTION

It is an object of the present invention to provide a coaxial waveguide assembly with an air-tight window plate made of a dielectric material, wherein integral parts have high electric and mechanical reliability and assembly can be easy.

According to the present invention, there is provided a microwave apparatus comprising:

a microwave resonant cavity;

first coaxial waveguide assembly having first outer and inner conductor sections which are air-tightly coupled to said microwave resonant cavity extended from said microwave resonant cavity and a first thick metal block, and the first inner conductor section being coaxially located inside of the first outer conductor section and provided with a distal end section to which the first thick metal block is fixed, the first thick metal block being provided with a distal end face, a first cylindrical recess of a predetermined depth being opened at the distal end face and a second cylindrical recess coaxially arranged with the first cylindrical recess and opened in the first cylindrical recess, and the second cylindrical recess having a diameter smaller than that of the first cylindrical recess; and a second coaxial waveguide assembly air-tightly coupled to said first second coaxial waveguide assembly to assemble a coaxial waveguide of the microwave apparatus, said second coaxial waveguide assembly having a second outer conductor section which is provided with a first thin metal cylinder, a second inner conductor section which is coaxially arranged in the second outer conductor section and provided with a second thin metal cylinder and a distal end, a second thick metal block fixed to the distal end of the second inner conductor, and a air-tight dielectric window plate which is air-tightly jointed between the inner and outer thin metal cylinders to define a vacuum space, wherein the second metal block is fitted in the second cylindrical recess of the first metal block in the vacuum space and mechanically and electrically connected thereto to form an inner coupling section and the first outer conductor section being air-tightly welded to the second outer conductor section to form a outer coupling section, the inner coupling section having a high frequency matching annular groove being defined between the second metal block and the first metal block.

DETAILED DESCRIPTION OF THE PREFERRED EMBODIMENT

An embodiment will be described with reference to FIGS. 2 to 7 to which a straight beam multicavity klystron is applied.

Figure 1:
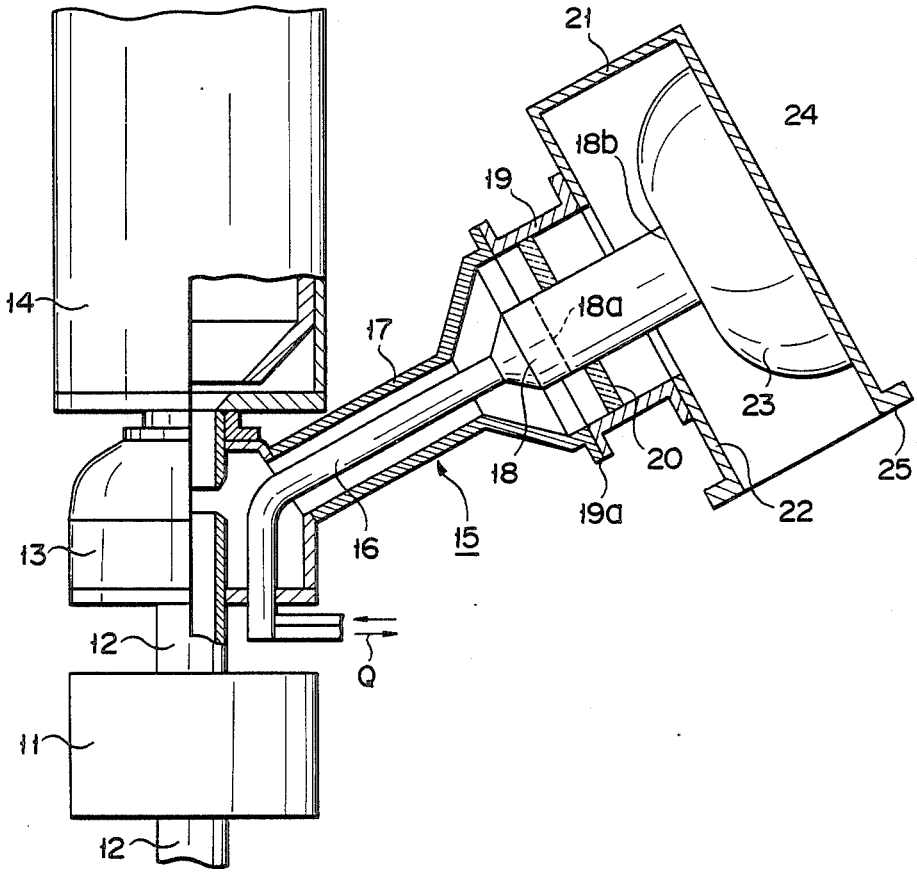
FIG. 1 is a sectional view showing part of an output section of a conventional klystron.
Figure 2:
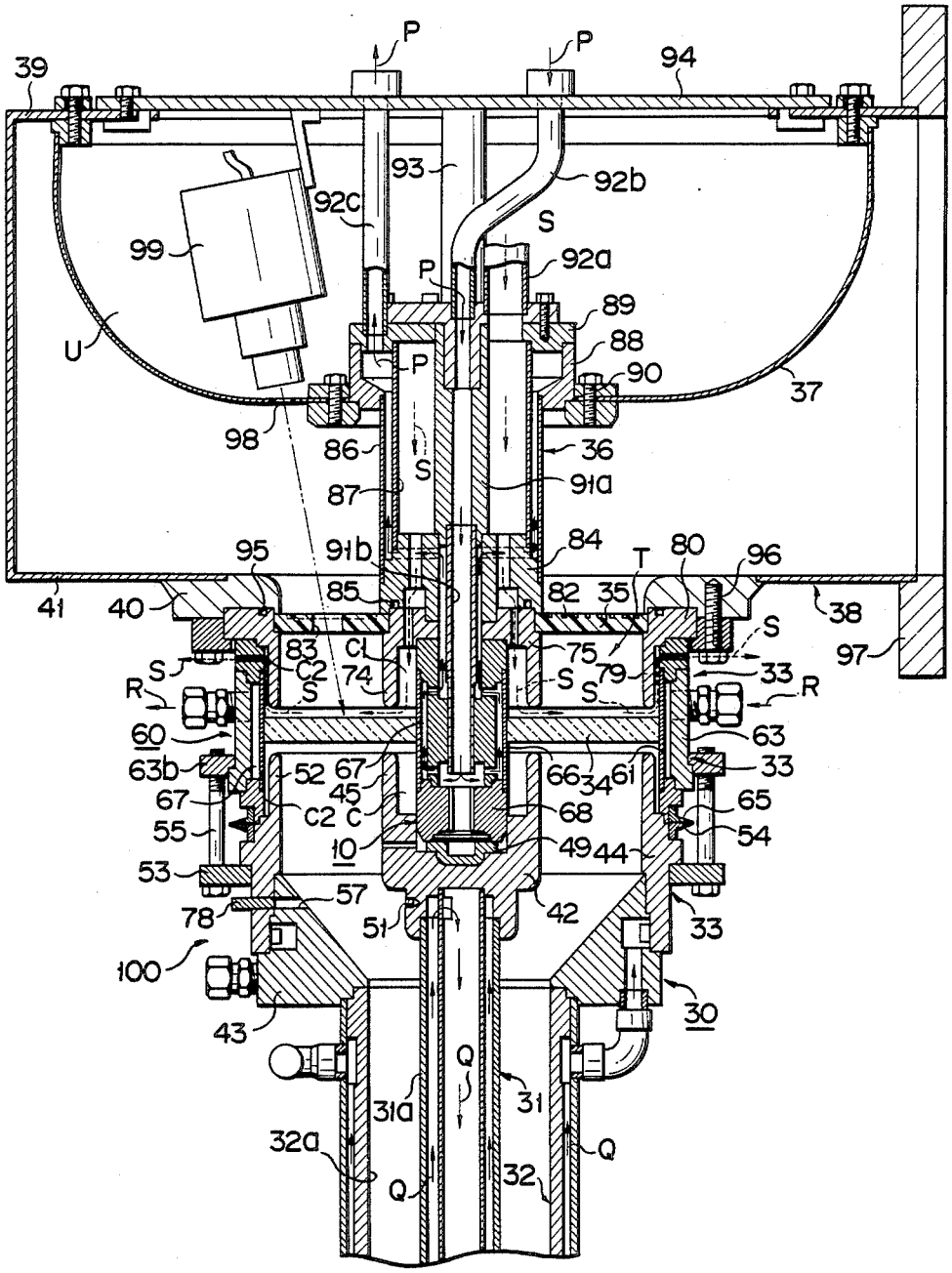
FIG. 2 is a schematic longitudinal sectional view of an output coaxial waveguide assembly of a klystron according to an embodiment of the present invention.
Figure 3:
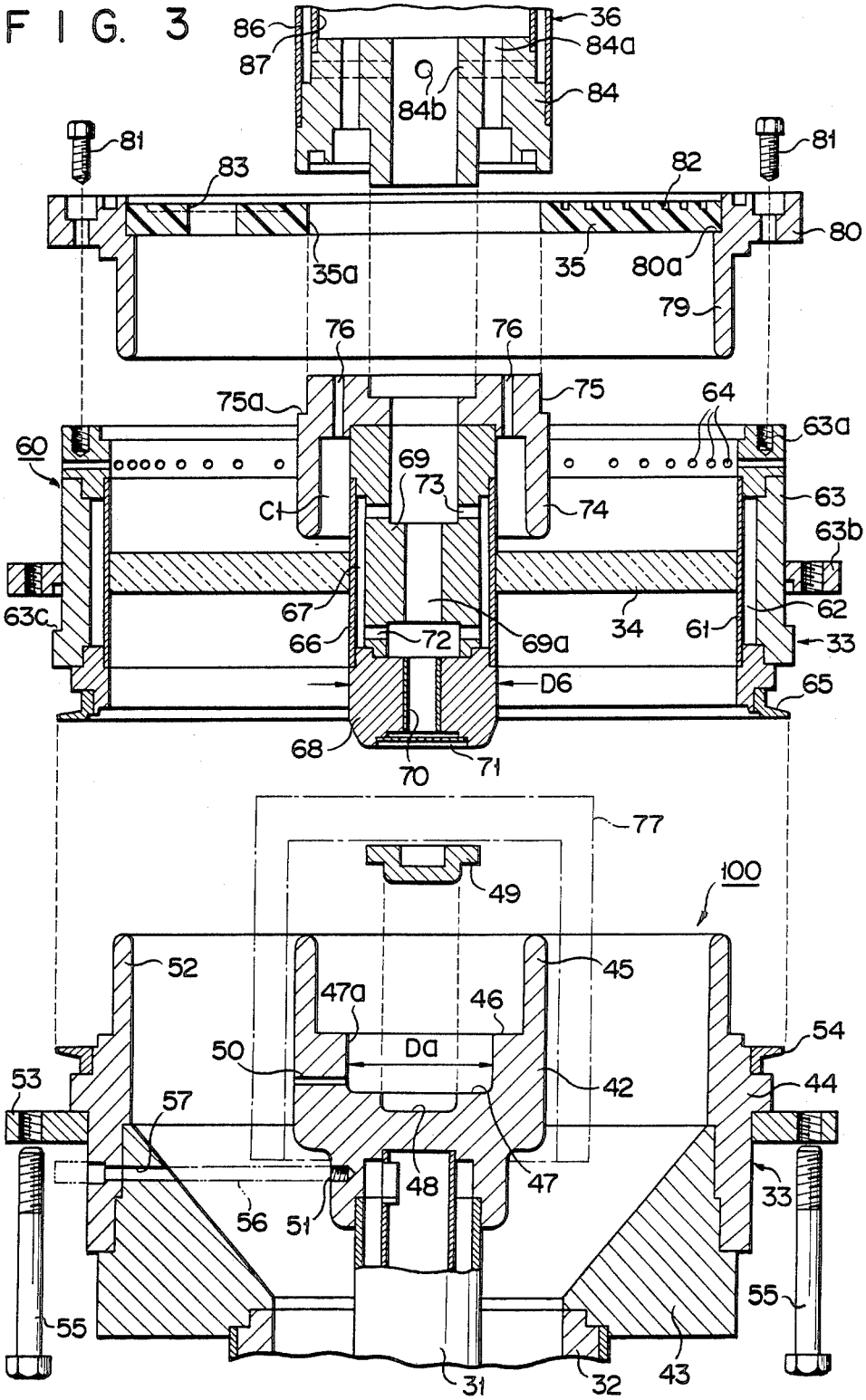
FIG. 3 is an exploded sectional view showing part of the output coaxial waveguide assembly shown in FIG. 2.
Figure 4:
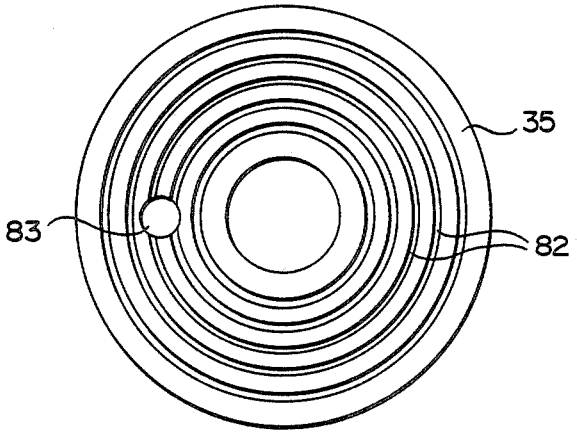
FIG. 4 is a plan view of the assembly shown in FIG. 3.
Figure 7:
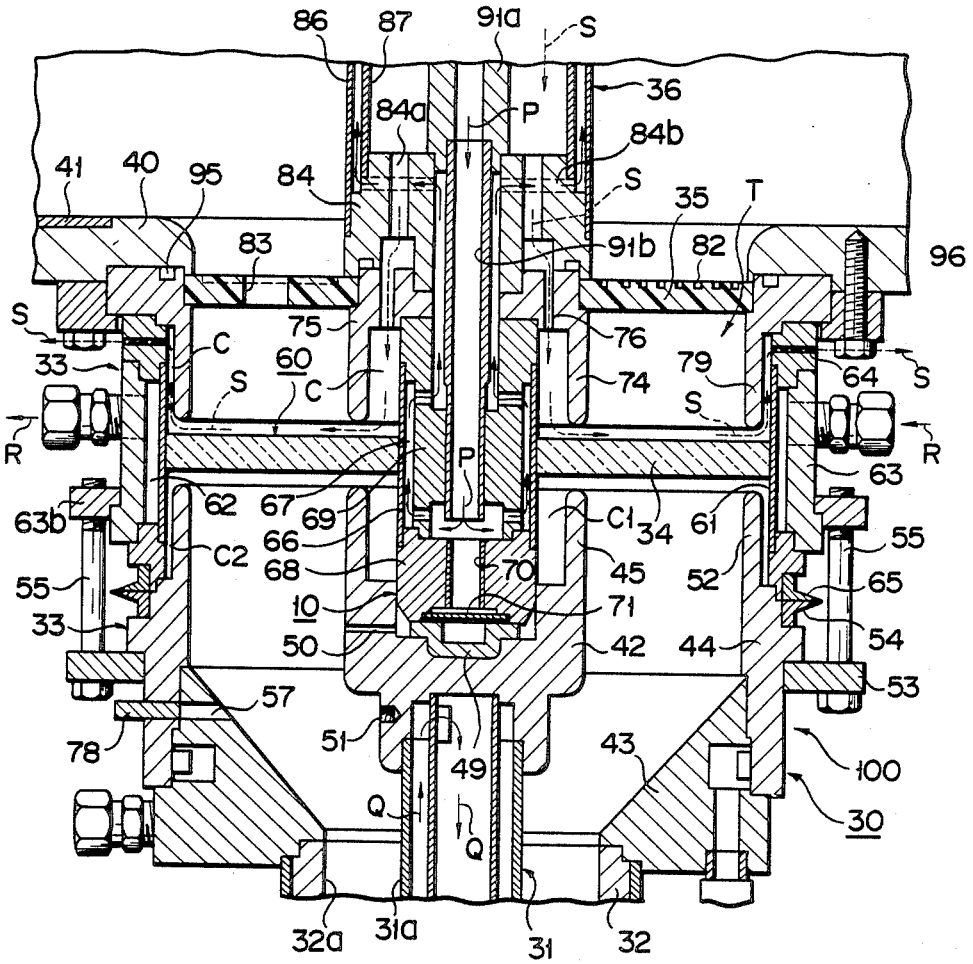
FIG. 7 is a sectional view showing the output coaxial waveguide assembly when the components shown in FIG. 3 are assembled.

Output coaxial waveguide assembly 30 is air-tightly connected to an output cavity of a klystron body (not shown). Waveguide assembly 30 includes air-tight coaxial window assembly (second separation assembly) 60, as shown in FIGS. 2, 3, and 7. More specifically, air-tight window plate 34 made of a dielectric ceramic material is air-tightly joined between inner conductor 31 and outer conductor 32. Dielectric partition disk 35 is mechanically fixed between inner conductor 31 and outer conductor 32 near window plate 34 on the outer atmosphere side. In outer extended section 36 of conductor 31 which extends toward the outer atmosphere side, a thin conductor plate shown in FIG. 2 is electrically and mechanically connected to cup-like enlarged section 37 and one wide surface 39 of output rectangular waveguide 38. Cooling water circulates in extended section 36 of inner conductor 31 in a direction indicated by arrow P. Distal end flange 40 of large-diameter section 33 is connected to the opening of the other wide surface 41 of rectangular waveguide 39. Outer extended section 31*a* of the inner conductor in the vacuum space is connected to the output cavity, as described above. Cooling water circulates in the inner and outer conductors in directions indicated by arrows Q.

The structures of the components will be described according to preferable assembly procedures.

In first separation assembly 100, inner conductor 31 includes cap like thick metal block 42 made of copper, and outer conductor 32 includes outer conductor funnel section 43 with a copper inner tapered surface and outer cylinder 44. Funnel section 43 and cylinder 44 constitute part of the large-diameter section 33 of the outer conductor 32. Thick metal block ring 42 of inner conductor 31 has first inner RF matching cylinder 45 and three recesses 46, 47, and 48 (FIG. 3) therein which are coaxially arranged and constitute a three-step structure. Reinforcing disk 49 having a step and made of a high-tensile material such as stainless steel is fitted in bottom recess 48. Thick metal block 42 of the inner conductor has small vent hole 50 and threaded alignment hole 51 formed in the outer surface of metal block 42. Cylinder 44 has first outer RF matching section 52 at its distal end. Fixing flange 53 and sealing flange 54 made of a thin stainless plate are joined to the outer surface of cylinder 44. Holes for respectively receiving a plurality of bolts (to be described later) are formed in flange 53. Through hole 57 is formed in parts of funnel section 43 and female threaded hole 51 so as to threadably engage alignment jig 56 (FIG. 3) with hole 57. The end section of first separation assembly 100 having inner and outer conductors 31 and 32 is integrally fixed to the output cavity of the klystron.

Air-tight coaxial window assembly 60 as the second separation assembly having dielectric air-tight window plate 34 is assembled independently of first separation assembly 100. In assembly 60 serving as the second separation assembly, thin metal cylinder 61 is air-tightly fitted on the outer circumferential surface of window plate 34. Cooling jacket 63 is joined to cylinder 61 to define annular cooling chamber 62 for cooling window plate 34, as is best shown in FIG. 3. External cooling water is supplied to chamber 62 and drained therefrom in a direction of arrow R. A plurality of radial vent holes 64 are formed in jacket 63 (FIG. 3) of second separation assembly 60 on the outer atmospheric side. Sealing flange 65 (FIG. 3) made of a thin stainless steel is formed on the end section of the jacket 63 and is to be brought into tight contact with sealing flange 54. A plurality of female threaded holes 63*a* are formed in the upper end face of jacket 63. Fixing ring 63*b* is fitted on the outer surface of ring 63 and can abut against annular projection 63*c*. Thin metal cylinder 66 is air-tightly brazed on the inner circumferential surface defining the central hole of dielectric air-tight window plate 34. Cylindrical inner thick metal block 68 made of copper and inner cylinder 69 are fixed to the inner surface of thin metal cylinder 66 to define annular cooling chamber 67 for cooling window plate 34. Outer diameter D6 of metal block 68 is slightly larger than diameter Da of recess 47 of metal block 42 constituting part of the inner conductor prior to assembly. Metal block 68 has central female threaded hole 70 and the opening of block 68 is air-tightly closed by thin partition plate 71, thereby constituting an air-tight structure of metal block 68. However, the air-tight structure of metal block 68 may be designed by a cap with a bottom so as to cause the block 68 itself to serve as a air-tight sealing section.

Air-tight window assembly 60 has a structure for keeping the space in the outer conductor air-tight in cooperation with dielectric window plate 34 and metal block 68 having an air-tight sealing section. As shown in FIG. 3, a pair of radial through holes 72 and a pair of radial through holes 73 are formed to cause annular cooling channel 67 to communicate with cooling channel 69*a* in cylinder 69 so as to circulate cooling water in chamber 67 defined between inner cylinder 69 and thin metal cylinder 66. Second connecting cylinder 75 having RF matching section 74 is connected to the upper end of cylinder 69. Inner surface of 74 is faced to a part of thin metal cylinder 66 RF matching section through a gap having a predetermined distance and the distal end of matching section 74 extends near air-tight window plate 34. A plurality of parallel vent holes 76 are formed in the bottom of cylinder 75 along the axial direction thereof. A coating layer (not shown) for suppressing a multipactor discharge, such as a titanium nitride, having thickness of 100 Å is formed on the inner surface of aperture plate 34. Assembly 60 is assembled independently of first assembly 100. Since air-tight window assembly 60 including the dielectric aperture plate 34 coupled between inner and outer conductors 31 and 32 can be assembled independently of the Klystron tube. Therefore, the air-tight joint section can have high reliability. In particular, the inner and outer circumferential surfaces of the dielectric window plate 34 can be air-tightly coupled to the outer and inner conductors. In addition, the multipactor suppration coating layer can be firmly formed on the dielectric air-tight window plate.

Air-tight window assembly 60 is coupled to ends of inner and outer conductor extending from the output resonance cavity in the following manner. Inner metal block 42 is placed in compact electric furnace 77 (indicated by the alternate long and short dashed line in FIG. 3) for locally heating metal block 42. Before the metal block 42 is locally heated, alignment jig 56 (indicated by the alternate long and two short dashed line in FIG. 3) is inserted in through hole 57 extending through funnel section 43 and cylinder 44 and the distal end section of jig 56 is threadably engaged with female threaded hole 51 in metal block 42, thereby aligning funnel section 43, cylinder 44, and cap metal block 42. In this state, the inner conductor is accurately concentric with the outer conductor. Metal block 42 is heated to a predetermined temperature. Electric furnace 77 is removed from metal block 42 while metal block 42 is being thermally expanded. First separation assembly 100 is matched with window assembly 60 as the second separation assembly. The distal end of metal block 68 is inserted simply or under pressure to brought into tight contact with inner surface 47*a* of thermally expanded metal block 42. When assemblies 60 and 100 coupled to each other are cooled to room temperature, metal block 68 and metal block 42 are mechanically and electrically coupled to each other by shrinkage fite. The shrinkage fitted coupling section is represented by reference numeral 10.

Fixing flange 53 and ring 63*b* are tightened by bolts 55. Sealing flanges 54 and 65 of outer conductor 32 are so joined as to constitute an integral flange extending in the circumferential direction. The integral flange is welded by arc welding to obtain an air-tight structure. Large-diameter sections 33 of outer conductor 32 are air-tightly joined, and at the same time cylinders 44 and 61 of outer conductor 32 are electrically connected. Upon completion of the above operation, alignment jig 56 is removed from female threaded hole 51 and through hole 57. Through hole 57 is then air-tightly sealed by sealing member 78.

The above components are assembled to obtain a microwave structure. As shown in FIG. 7, the outer surface of thin metal cylinder 66 joined to dielectric window plate 34 is surrounded by first RF matching section 45 through a predetermined gap. Matching sections 45 and 74 defines grooves $C_1$ for eliminating impedance discontinuity near the dielectric air-tight window plate, thereby preventing electromagnetic reflection. Cylindrical matching sections 45 and 74 adjacent to each other shield the air-tight brazed section between thin walled cylinder 66 and window plate 34 from an RF electromagnetic field. This air-tight brazed section is located substantially inside annular RF matching groove $C_1$. An RF current supplied to the brazed section is decreased by matching sections 45 and 74 so that it is protected from over heating thereof. As shown in FIG. 7, shrink-fitted coupling section 10 is located deep inside annular RF matching groove $C_1$ and is supplied with few RF current. Therefore, mechanical and electrical connections of shrink-fitted section 10 can be guaranteed. The components of the inner conductor are shrink-fitted and then the components of the outer conductors are welded.

Second outer RF matching section 79 is disposed on cooling jacket cylinder 63. Partition plate holding cylinder 80 having section 79 constituting part of the outer conductor is coupled to large-diameter section 33 by threadably engaging bolts 81 with female threaded holes 63*a*. The inner circumferential surface of partition disk 35 which defines central hole 35*a* and which is made of a dielectric material, e.g., Teflon (tradename) having a small RF loss is fitted in step 75*a* of second matching cylinder 75 on the inner conductor side. Partition disk 35 prevents cooling air from being spilled and causes it to direct toward the entire surface of window plate 34 on the atmospheric side (this operation will be described in detail later). At the same time, disk 35 increases mechanical strength of the inner and outer conductors. Concentric grooves 82 (FIG. 4) are formed in the surface of partition disk 35 to improve RF breakdown. Relatively small through hole 83 (FIG. 4) is formed in part of disk 35 to monitor the window plate 34. Matching sections 79 and 52 and thin metal cylinder 61 constitute annular matching groove C for obtaining good RF matching near the dielectric window plate. Similarly, matching sections 79 and 52 adjacent to each other shield the air-tight brazed section between thin metal cylinder 61 and window plate 34 from the RF electromagnetic field. Contact sections of outer thin metal cylinder 61 and the outer cylinders 44 and 80 are located inside groove $C_2$ and are supplied with few RF current, thus obtaining high reliability of joint sections.

Figure 5:
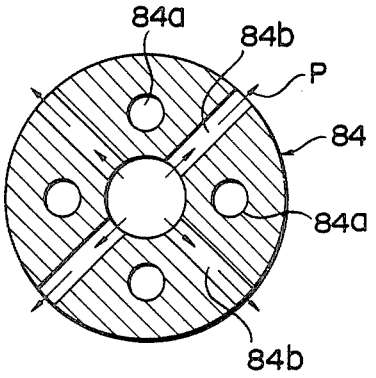
FIG. 5 is a cross-sectional view of the assembly shown in FIG. 3.
Figure 6:
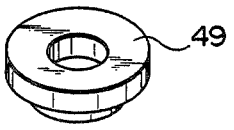
FIG. 6 is a perspective view of a reinforcing disk shown in FIG. 3.

Coolant guide member 84 is connected to the upper surface of second matching cylinder 75 through O-ring 85 (FIG. 2) to guide cooling water and cooling air. Guide member 84 has substantially a cylindrical shape. Four cooling air through holes 84*a* (FIG. 5) are formed parallel to each other along the axial direction of guide member 84. Four cooling water through holes 84*b* (FIG. 5) are radially formed at positions offset from holes 84*a* in the circumferential direction. Holes 84*a* and 84*b* are alternately formed. Cylinder 86 (FIG. 2) constituting outer extended section 36 of the inner conductor and coolant partition cylinder 87 located inside cylinder 86 are brazed on guide member 84. Cup-like enlarged section 37 is connected to upper end flange 88 (FIG. 2) by bolts 90 (FIG. 2). Cooling water pipes 91*a* and 91*b* (FIG. 2) are inserted into a central through hole of inner extended section 36 and are liquid-tightly fixed therein. Cooling air pipe 92*a* is connected to flange 89, cooling water supply hose 92*b* is connected to guide pipe 91, and drain hose 92*c* is connected to flange 89. Pipes 92*a*, 92*b*, and 92*c* extend outside the waveguide. These pipes are mechanically supported on support plate 94 by column 93, as shown in FIG. 2. Cooling water is circulated through the respective components in the P direction, as shown in FIGS. 5 and 7, thereby cooling the microwave assembly. Cooling air is blown from atmospheric-side vent hole 76 formed deep inside the second matching member to the surface of the dielectric window plate through annular matching groove $C_1$. Cooling air is then radially directed by space T defined by window plate 34 and partition disk 35. Air is then exhausted outside from vent hole 64 through groove $C_2$ of cylinder 80. Vent holes 76 and 64 formed in the inner and outer conductors have a size enough to block the RF components and are located deep inside inner and outer grooves $C_1$, $C_2$. Therefore, leakage of RF components from the vent holes can be perfectly prevented.

In the outer conductor, flange 40 is connected to partition plate holding cylinder 80 through conductive O-ring 95 by bolts 96 and is fixed integrally with rectangular waveguide 38. Connecting flange 97 (FIG. 2) is formed on waveguide 38 to connect the microwave structure to an external load RF circuit.

Small through hole 98 (FIG. 2) having a size enough to block the RF components is formed in part of the cup-like enlarged section 37. Sensor device 99 (FIG. 2) arranged inside cup-like space U of the thin conductor plate constituting the cup-like enlarged section detects a temperature of window plate 34 and the presence/absence of an RF arc discharge produced to near window plate 34 through through hole 98, 83. The sensor device may be arranged outside the waveguide or may be detachably arranged in accordance with whether monitoring is required or not.

Coupling section 10 may be reliably formed by an another technique in stead of shrinkage fite technique. For example, the outer member of the iointing section may be heated, and/or the inner member of the jointing section may be cooled. Alternatively, the above techniques may be combined as needed.

According to the present invention as described above, since the inner conductor is constituted by mechanical fitting such as shrinkage fite. Therefore, metal materials (e.g., copper) having a high RF conductivity can be directly connected, and the resultant member is substantially free from the RF loss. If the joint section by tight fitting is formed deep inside the annular matching groove, few RF current is supplied to the shrink-fitted coupling section. As a result, highly reliable mechanical and electrical connections can be achieved.

The present invention is not only applied to the RF coupling section between the coaxial waveguide and the rectangular waveguide, but also to various coaxial waveguide structures each having the inner and outer conductors and the air-tight window assembly.

According to the present invention as described above, since the members of the inner conductor are integrally connected by mechanical fitting such as shrink fitting, the members made of a highly conductive metal material can be directly connected. The resultant structure is almost free from the RF loss. The air-tight coupling can be achieved by welding only in the outer conductor, thus simplifying the manufacturing process and increasing reliability of the coupling section. In particular, the present invention is best suitable for a coaxial waveguide assembly for an RF (e.g., 1 MW or more) continuous wave transmission.

What is claimed is:

1. A microwave apparatus comprising:

a microwave resonant cavity;

first coaxial waveguide assembly having first outer and inner conductor sections which are air-tightly coupled to and extended from said microwave resonant cavity and a first thick metal block, and the first inner conductor section being coaxially located inside of the first outer conductor section and provided with a distal end section to which the first thick metal block is fixed, the first thick metal block being provided with a distal end face, a first cylindrical recess of a predetermined depth opened at the distal end face and a second cylindrical recess coaxially arranged with the first cylindrical recess and opened in the first cylindrical recess, and the second cylindrical recess having a diameter smaller than that of the first cylindrical recess; and a second coaxial waveguide assembly air-tightly coupled to said first coaxial waveguide assembly to assemble a coaxial waveguide of the microwave apparatus, said second coaxial waveguide assembly having a second outer conductor section which is provided with a first thin metal cylinder, a second inner conductor section which is coaxially arranged in the second outer conductor section and provided with a second thin metal cylinder and a distal end, a second thick metal block fixed to the distal end of the second inner conductor, and an air-tight dielectric window plate which is air-tightly jointed between the inner and outer thin metal cylinders to define a vacuum space, wherein the second metal block is fitted in the second cylindrical recess of the first metal block in the vacuum space and mechanically and electrically connected thereto to form an inner coupling section and the first outer conductor section being air-tightly welded to the second outer conductor section to form an outer coupling section, the inner coupling section having a high frequency matching annular groove being defined between the second metal block and the first metal block.

2. An apparatus according to claim 1, wherein the first metal block is shrinked after the first metal block is heated so that the second metal block is fitted into the first metal block.

3. An apparatus according to claim 1, wherein the second metal block is shrinked after the second metal block is cooled, so that the second metal block is fitted in the first metal block.

4. An apparatus according to claim 1, wherein the dielectric plate has a surface which is located in the vacuum space and coated with a material for suppressing multipactor discharge.

5. An apparatus according to claim 1, wherein the first outer and inner conductor sections have large diameter portions having predetermined first and second diameters and small diameter portions, respectively, the second outer and inner conductor sections have diameters same as the first and second diameters of the first outer and inner conductor sections, the small diameter portions of the first outer and inner conductor sections are extended from said microwave resonant cavity, and the large diameter portions of the first outer and inner conductor sections are coupled to the second outer and inner conductor sections.

6. An apparatus according to claim 1, wherein the second metal block has a through hole extending along an axial direction thereof and opened at the distal end, and said second coaxial waveguide further has an air-tight thin metal partition plate jointed to the second metal block for air-tightly sealing the through hole.

7. An apparatus according to claim 6, wherein the second metal block has an inner surface defining the through hole, and a female screw is formed in the inner surface of the second metal block.

8. An apparatus according to claim 6, wherein the first metal block further has a third recess coaxially arranged with the first and second recesses and opened in the second recess, and the second coaxial waveguide assembly further has a disk disposed between the first metal block and the second metal block and fitted into the second and third recesses, and has a larger mechanical strength than that of the first metal block.

* * * * *